United States Patent [19]

Silver

[11] 4,354,294

[45] Oct. 19, 1982

[54] ROTARY WALL DESLAGGER

[75] Inventor: Theodore R. Silver, Erie, Pa.

[73] Assignee: White Consolidated Industries, Inc., Cleveland, Ohio

[21] Appl. No.: 185,949

[22] Filed: Sep. 10, 1980

[51] Int. Cl.[3] ..... F23J 3/02

[52] U.S. Cl. ..... 15/317; 122/392; 134/167 C

[58] Field of Search ..... 15/316 R, 316 A, 317; 122/390–392; 134/166 C–168 C

[56] References Cited

U.S. PATENT DOCUMENTS

| | | | |
|---|---|---|---|
| 1,924,550 | 3/1930 | Hibner, Jr. et al. | 122/392 |
| 2,008,510 | 11/1932 | MacConville | 122/392 |
| 2,248,947 | 3/1938 | Bowers | 122/392 |
| 2,298,995 | 10/1942 | Wilson | 122/392 |
| 2,319,682 | 8/1940 | Hibner et al. | 122/392 |
| 2,324,785 | 1/1940 | Linaker | 122/392 |
| 2,351,117 | 7/1940 | Glinn et al. | 122/392 |
| 2,486,585 | 1/1946 | Brelsford | 15/317 |
| 2,491,838 | 1/1946 | Thomas | 15/317 |
| 2,885,711 | 8/1956 | DeMart | 15/317 |
| 3,593,691 | 7/1971 | Wirths et al. | 122/390 |
| 4,257,359 | 3/1981 | Capobianco | 15/317 X |

FOREIGN PATENT DOCUMENTS

| | | | |
|---|---|---|---|
| 2027512 | 2/1980 | United Kingdom | 134/167 C |
| 2031101 | 4/1980 | United Kingdom | 134/167 C |

*Primary Examiner*—Robert L. Bleutge

*Attorney, Agent, or Firm*—Mandeville and Schweitzer

[57] ABSTRACT

The disclosure is directed to a rotary wall deslagger for cleaning boilers. In accordance with the invention, an extensible rack element is selectively, mechanically coupled to a rotatable lance tube of the rotary wall deslagger to move the lance tube between a working and non-working position. When the selective mechanical coupling between the rack and the lance tube is released, the rack is extensible relative to the lance tube to activate a cleaning fluid discharge means and a driving means to impart a rotary motion to the lance tube. In accordance with another feature of the invention, the selectively-operable, mechanical coupling is released after the lance tube has been moved to its working position and the cleaning fluid discharge means and the rotary drive means are activated by the rack element substantially simultaneously with one another so that the cleaning fluid reaches the discharge nozzle of the lance tube at full pressure as rotation of the lance tube begins.

14 Claims, 6 Drawing Figures

ROTARY WALL DESLAGGER

BACKGROUND AND SUMMARY OF THE INVENTION

The invention is directed to a rotary wall deslagger for cleaning boilers and is of the type comprising a cleaning fluid flower nozzle mounted on a rotatable lance tube which is advanced into an operative position within the boiler and retracted from such position when not in use.

In the operation of boilers, the burning of combustible fuels results in a gradual build-up over a period of time of a layer of slag on the boiler walls. It is therefore necessary to periodically clean the heated surfaces of the boiler to deslag such surfaces. The removal of slag properly maintains the heat conduction efficacy of the boiler at an optimum level, thereby insuring the most efficient utilization of available fuel supplies. Typically, the boiler surfaces are cleaned by inserting a rotatable lance tube, mounting a front nozzle, into the combustion space of the boiler and projecting a cleaning fluid such as steam, air and/or water from the nozzle against the surfaces to be cleaned. The lance tube is retracted from the boiler when not in use and held outside the hot and possibly damaging combustion zones of the boiler to protect the deslagging apparatus from the deleterious effects of the combustion process during the relatively long periods of time that the deslagger is inoperative.

Accordingly, the prior art has proposed many apparatuses for advancing, retracting, rotating and discharging a cleaning fluid through a rotatable lance tube. It has been an objective of those skilled in the art, to accomplish a fast and efficient transverse and rotational motion for the tube and to coordinate a valve operation for cleaning fluid discharge with lance movement to achieve the best possible cleaning action with the fluid discharge. A particular problem associated with rotary deslaggers has been premature cleaning fluid discharge whereby the cleaning fluid reaches the nozzle prior to nozzle rotation. This results in a highly inefficient use of the cleaning fluid and over exposure of certain portions of the boiler interior to the cleaning fluid.

It is a primary objective of the present invention to provide a new and improved rotary boiler wall deslagger which incorporates a highly effective and straightforward mechanism for advancing and retracting the lance tube and for initiating fluid discharge when the lance tube is fully extended and substantially simultaneously with the commencement of rotational movement thereof. In this manner, all of the discharged fluid is effectively used as a cleaning medium and the lance tube is subjected to the hot combustion zone for a minimum time period.

Generally, the wall deslagger of the invention comprises a frame structure mounting a rack housing, a rotary gear box, a valve and valve operator assembly. The frame structure also slidably supports a hollow, rotatable lance tube. A traversing rotary gear box is mounted to the rear end of the lance tube and includes a mechanical coupling with the rotary gear box of the frame structure whereby the lance tube may be rotated about its axis.

In accordance with a significant feature of the invention, a rack member is slidably associated with the lance tube and is capable of a predetermined limited longitudinal displacement relative to the lance tube. Ordinarily, the rack member is locked in a fixed relation to the lance tube and is in a driven engagement with a pinion mounted in the rack housing of the frame structure. Traverse movement to advance and retract the lance tube is achieved by operation of the pinion to drive the rack member. When the lance tube is in a fully extended position in the boiler, a mechanism releases the lock securing the fixed relation between the rack member and the lance tube thereby permitting continued advancing movement of the rack member. The rack member will then be able to advance to an operative engagement with the valve operating assembly to open the valve and discharge cleaning fluid to the lance interior after the lance has been fully extended. An appropriate limit switch is positioned such that the rack member activates the switch to commence a rotary drive to the lance tube substantially simultaneously with cleaning fluid discharge whereby the cleaning fluid reaches the nozzle at full pressure as rotation begins.

The cleaning cycle is terminated by a cam-activated switch. The cam is mounted on the lance tube and activates the switch after a full cleaning sweep by the lance tube. Closing of the switch activates the pinion to retract the rack member thereby closing the valve and retracting the lance tube to its inoperative position. The teachings of the inventive concept disclosed herein provide a highly reliable lance drive effectively coordinating lance movement and cleaning fluid discharge. The extensible rack arrangement affords a dependable, mechanically-straightforward means for imparting traverse motion to the lance tube while providing an accurately timed, advantageous fluid discharge.

For a better understanding of the above and other features and advantages of the invention, reference should be made to the following detailed description of a preferred embodiment of the invention and to the accompanying drawings.

DETAILED DESCRIPTION OF A PREFERRED EMBODIMENT OF THE INVENTION

Figure 1:
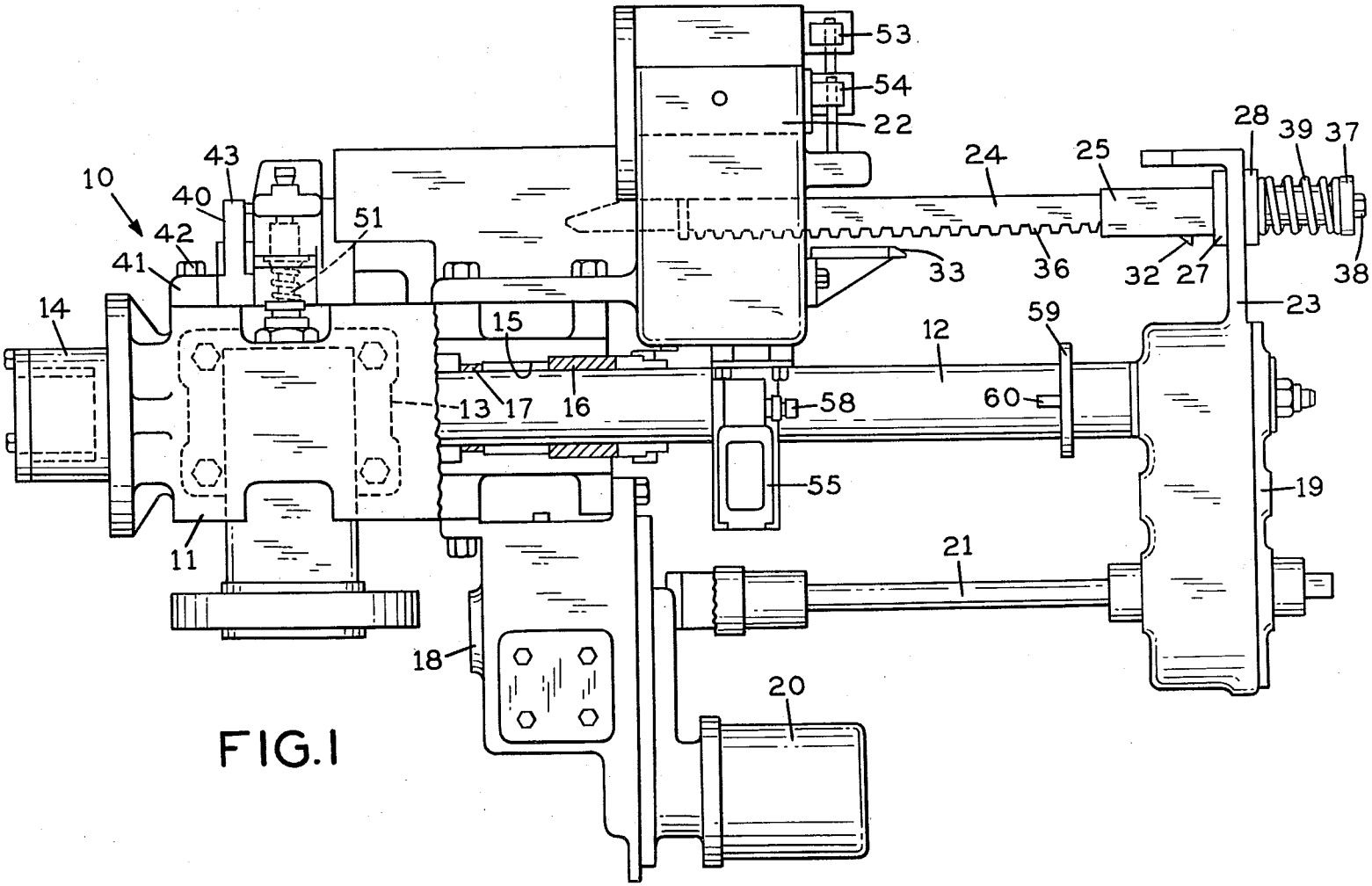
FIG. 1 is a side view in elevation, partially in cross section, of a rotary wall deslagger built in accordance with the teachings of the present invention.

Referring now to the drawings and initially to FIG. 1 thereof, there is illustrated a rotary wall deslagger generally indicated by the reference numeral 10. The deslagger includes a main support structure 11 which mounts the various operating components of the apparatus, as will appear, and rotatably, slidably supports a hollow lance tube 12. The support structure 11 is provided with a hollow, cylindrical front member 14 and is suitably mounted adjacent the outer wall of a public utility boiler (not specifically illustrated) such that the front member 14 is aligned with an opening in the boiler wall. As illustrated in FIG. 1, the lance tube 12 is axially aligned with the front member 14 whereby the tube 12 is slidable through the member 14 and into the boiler interior.

To advantage, the support structure 11 is provided with a longitudinally-disposed, cylindrically-shaped opening 15 which is aligned with the hollow interior of the front member 14 and serves as the main support structure for the lance tube 12. The inner diameter of the opening 15 is somewhat larger than the outer diameter of the lance tube 12 and suitable packing means 16, 17 are arranged between the lance tube 12 and the interior surfaces of the opening 15 to afford a firm support for the lance tube 12 while permitting rotational and longitudinal movement of the lance tube 12 relative to the main support structure 11.

In accordance with known deslagger design, the lance tube 12 is provided with a side opening (not shown) which is arranged in fluid communication with the outlet of a valve 13 mounted on the main support structure 11 whereby a suitable cleaning fluid, such as steam or water, may be injected into the interior of the lance tube 12. Moreover, a discharge nozzle (not shown) is mounted in a well known manner at the forwardmost end of the lance tube 12 so that when the lance tube 12 is inserted into the boiler, as discussed above, the discharge nozzle is appropriately positioned for a cleaning operation.

Rotational motion is imparted to the lance tube 12 by an advantageous arrangement of a stationary rotary gear box 18 mounted on the main support structure 11 and a traversing rotary gear box 19 mounted to and movable with the rearwardmost end of the lance tube 12. The stationary rotary gear box 18 includes an electric motor 20 as a driving input and a square-shaped output rod 21 which extends from the stationary rotary gear box 18 to a sliding, driving connection with the input of the traversing rotary gear box 19. Operation of the electric motor 20 will drive the square shaft 21 through the stationary rotary gear box 18 and, in turn, impart a rotary motion to the lance tube 12 through the traversing rotary gear box 19. The gear ratios of the rotary gear boxes 18, 19 may be fixed at a predetermined value to rotate the nozzle for an effective cleaning action on the boiler wall. By virtue of the above-described lance tube rotary drive arrangement, the electric motor 20 is mounted on the main support structure 11 rather than on the lance tube 12 thereby minimizing the weight of the lance tube 12 and facilitating an easy translational motion therefor. The square shaft mechanical interconnection between the stationary and traversing rotary gear boxes 18, 19 provides a highly reliable rotary drive for the lance tube 12 while permitting relative translational movement between the lance tube mounted gear box 19 and the stationary gear box 18.

In accordance with a significant feature of the present invention, a novel rack-and-pinion linear drive is provided to advance and retract the lance tube 12 between the deslagger's working and non-working positions. A rack housing 22 is mounted to the main support structure 11 above the lance tube 12 and just forward of the position occupied by the traversing rotary gear box 19 when the lance tube 12 is in its fully extended position. The traversing rotary gear box 19 includes an upwardly-extending, generally L-shaped member 23 to selectively, slidably support a rack element 24 in an aligned relation to the rack housing 22.

Figure 4:
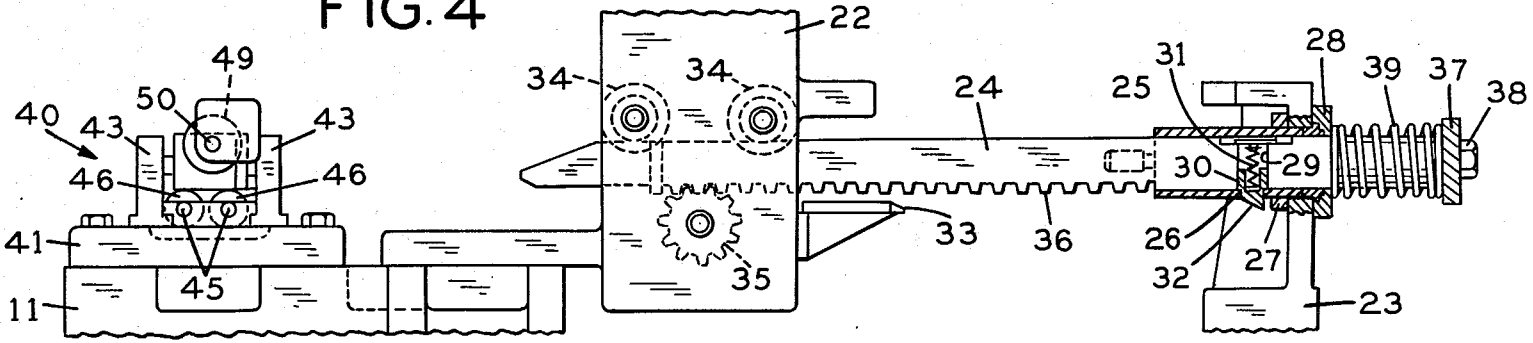
FIG. 4 is a partial side cross sectional view of the extensible rack member of the invention illustrated in the retracted position.

Referring now more particularly to FIG. 4, the L-shaped member 23 mounts a hollow, transverse sleeve 25 retained on the member 23 by collars 27, 28. The rearward portion of the rack element 24 is arranged to extend through the sleeve 25. A slot opening 26 is formed at the bottom of the sleeve, and a vertical bore 29 is formed in the rack element 24 such that the bore 29 is ordinarily aligned with the slot opening 26 of the sleeve 25. To lock the rack element 24 in a fixed relation to the sleeve 25, a pin 30 is slidingly received in the bore 29 and biased by a spring 31 to extend through the slot opening 26 of the sleeve 25. The bottom 32 of the pin 30 is inclined for cooperation with a disengaging finger 33, mounted on the rack housing 22. When the lance tube 12 is fully extended, the pin 30 is urged against the spring 31 and out of the slot opening 26. This permits an axial displacement of the rack element 24 relative to the lance tube 12 to initiate a cleaning fluid discharge, as will be fully explained hereinbelow.

The forward portion of the rack element 24 is received in the rack housing 22 between a pair of upper roll guides 34 and a pinion 35 arranged in a meshing engagement with the gear teeth 36 of the rack element 24. To advance and retract the lance tube 12, the pinion 35 is driven to impart axial movement to the rack element 24 which will move the lance tube 12 horizontally by virtue of the locked relationship between the rack element 24 and L-shaped member 23 of the traversing gear box 19. The rearwardmost portion of the rack element 24 is provided with an end plate 37 which is secured to the rack element as by a bolt 38. A coil spring 39 is received over and co-axial with the rearwardmost portion of the rack element 24 and acts between the end plate 37 and collar 28 to urge the rack element 24 toward the locked position with the transverse sleeve 25.

Figure 6:
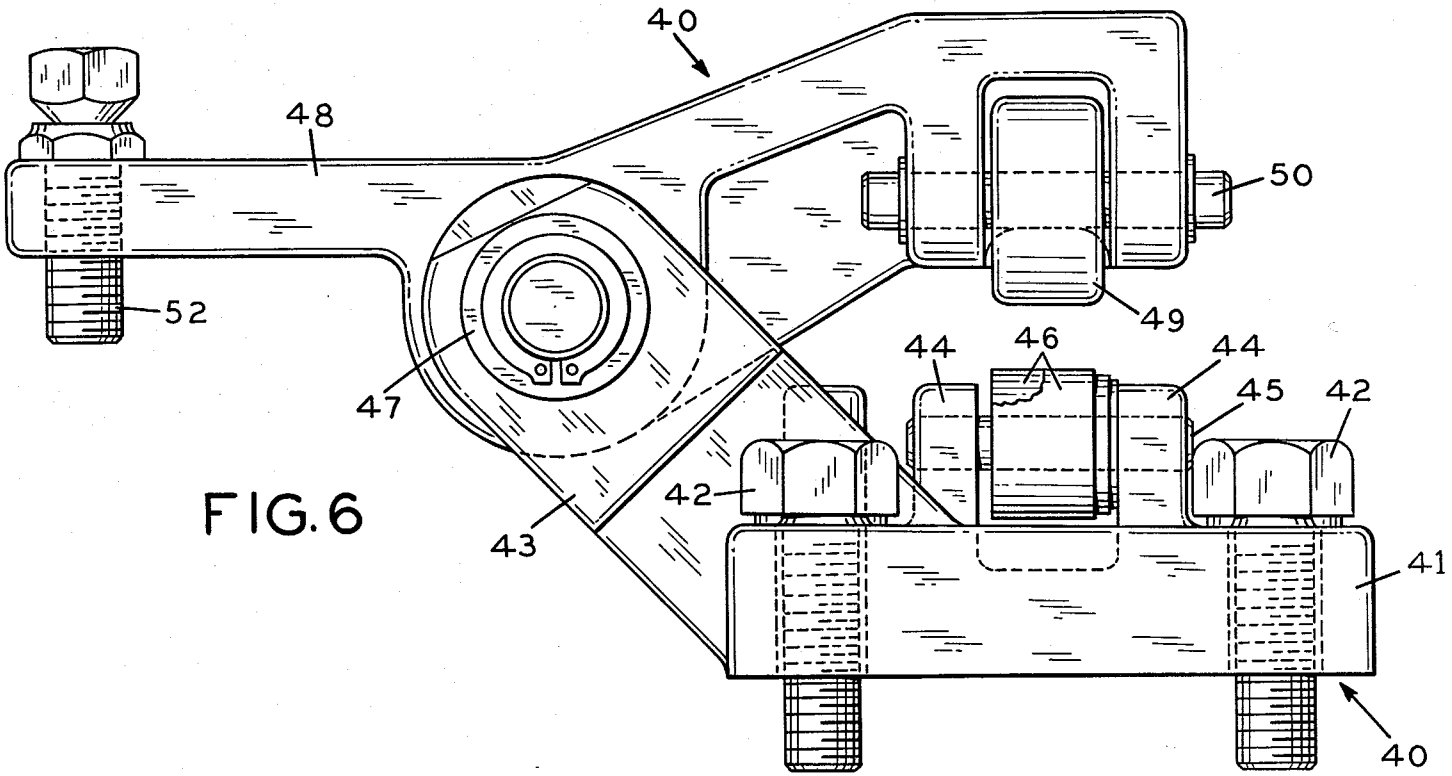
FIG. 6 is a detailed view of the lever valve actuator used in the rotary wall deslagger of the invention taken generally along line 6—6 of FIG. 4.

In accordance with another significant feature of the invention, a lever-type valve actuator 40 is mounted to the main support structure 11 downstream from the rack housing 22. As illustrated in FIG. 6, the valve actuator 40 generally comprises a base member 41 bolted to the main support structure 11 by bolts 42 and a pair of upwardly, angularly-extending lever support arms 43. A rotatable shaft 47 is mounted between the lever support arms 43 to pivotally support a lever 48. The righthand side of the lever 48 is formed to an inverted U-shaped bracket which rotatably supports an upper guide roller 49 by means of a shaft 50. A pair of oppositely facing shaft support members 44 rotatably supports two shafts 45 in a spaced relation, each of which mount a lower guide roller 46 (see also FIG. 4). The upper guide roller 49 is positioned above and midway between the lower guide rollers 46.

Figure 2:
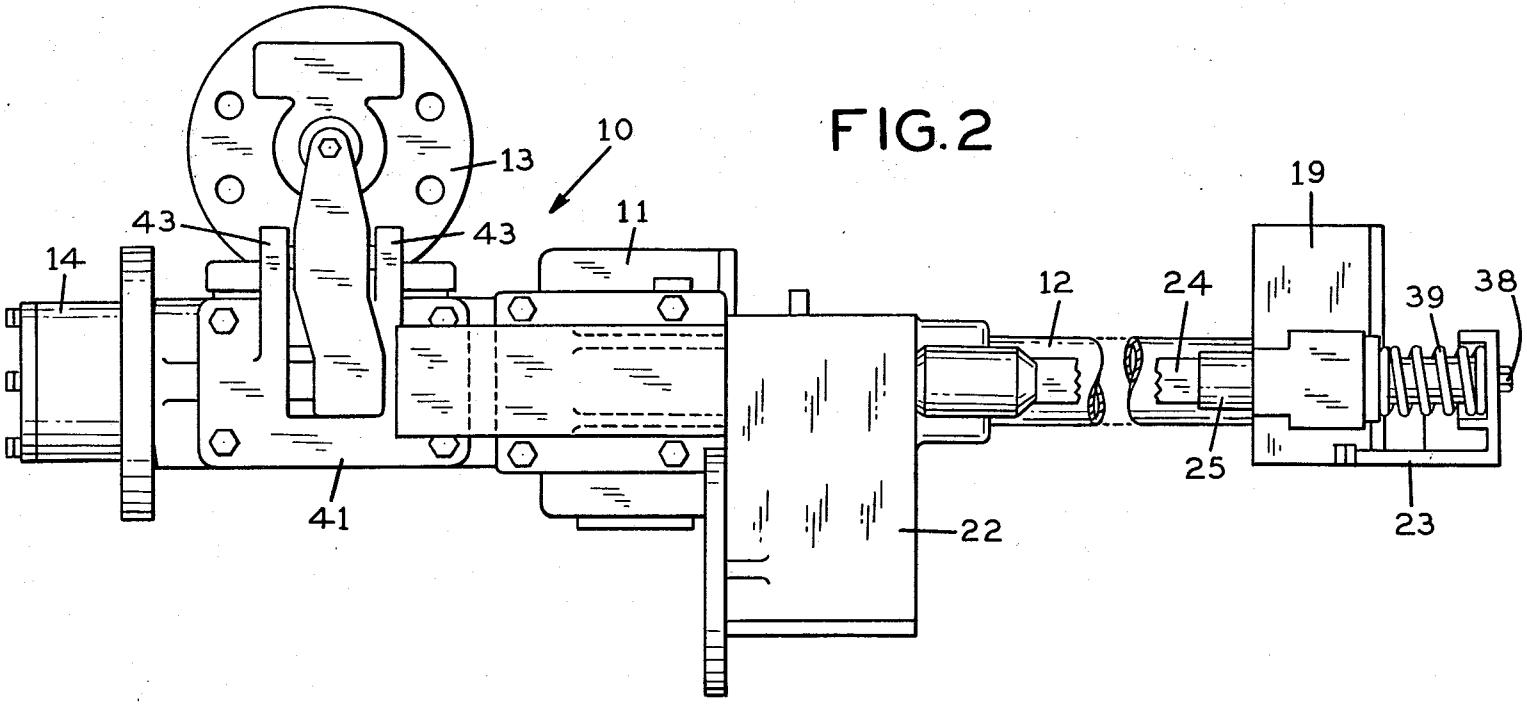
FIG. 2 is a top plan view of the rotary wall deslagger of FIG. 1.
Figure 3:
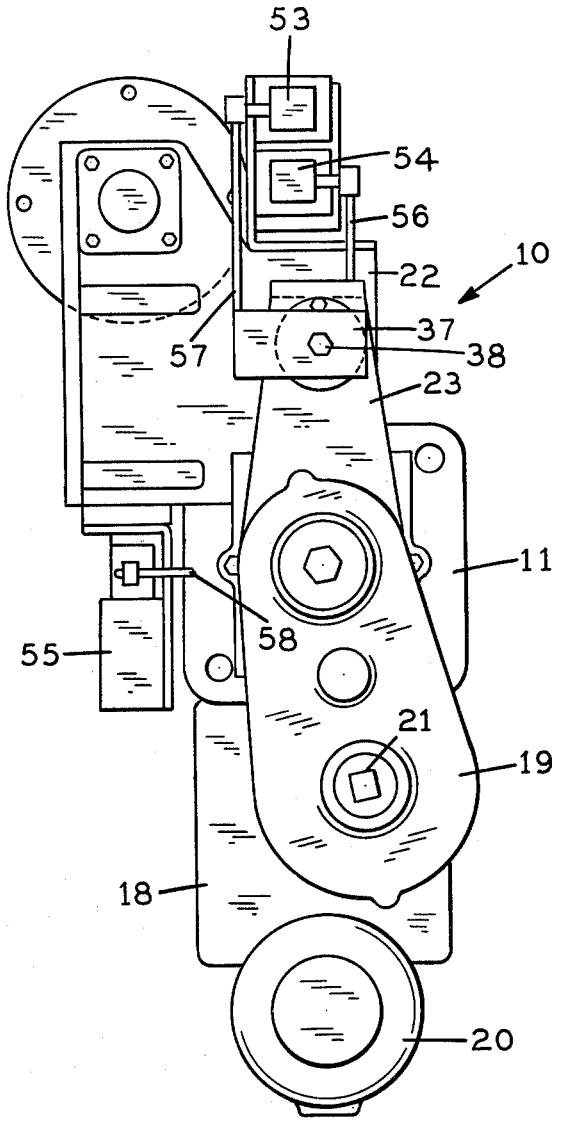
FIG. 3 is an end view of the rotary wall deslagger of FIG. 1.

In order to operate the valve 13, the lever actuator 40 is mounted on the main support structure 11 such that the lefthand side of the lever 48 is positioned above a normally-closed, spring-biased valve stem 51 of the valve 13, as clearly illustrated in FIGS. 1 and 2. An adjusting screw 52 is threadedly received through a threaded opening formed in the lever 48 at a position directly over the spring-biased valve stem 51. In this manner, the screw 52 will engage and depress the valve stem 51 upon a counter-clockwise pivoting motion of the lever 48 to open the valve 13.

In accordance with the invention, the lever 48 is engaged and pivoted by the leading end of the rack member 24, after full extension of the lance tube 12, whereby cleaning fluid is injected into the lance tube interior through the valve 13 after the nozzle is appropriately positioned within the boiler. To that end, the front portion of the rack member 24 is formed to a wedge-shaped configuration and is positioned in alignment with the spacing between the upper and lower guide rollers 46, 49 of the lever actuator 40. When the pinion 35 is operated to advance the rack member 24, the lance tube 12 moves toward the left until the traversing rotary gear box 19 abuts the main support frame 11. At this time, the inclined end 32 of the locking pin 30 contacts the disengaging finger 33 whereby the pin 30 is moved upwardly into the rack element 24 and the rack element 24 is then free to continue its forward movement against the action of the spring 39 (see FIG. 5).

Figure 5:
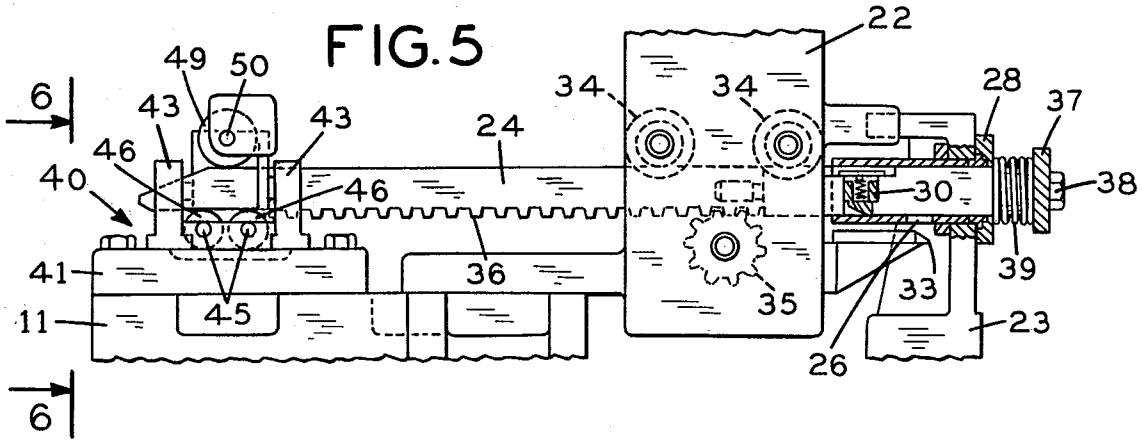
FIG. 5 is a partial, side cross sectional view of the extensible rack member of the invention illustrated in the fully extended position.

As clearly illustrated in FIG. 5, the continuing forward movement of the rack element 24 brings the wedge-shaped front of the rack element 24 into contact with the upper and lower guide rollers 46, 49 of the lever valve actuator 40. This action tends to pivot the lever 48 to operate the valve stem 51 as described above. The delay of pivoting action of the lever 48, until after the traversing rotary gear box 19 has abutted the main support structure 11, assures that cleaning fluid discharge into the lance tube 12 does not commence until the lance tube is fully extended into its operative position within the boiler.

To coordinate the translation and rotational motions of the lance tube 12 and to automatically complete a cleaning cycle of the deslagger, three electro-mechanical limit switches means 53, 54, 55 are mounted on the deslagger 10. The limit switch means 53, 54 are mounted adjacent the rack element 24 whereby the corresponding actuator levers 56, 57 thereof are mechanically associated with the rack member 24. The limit switch means 55 is mounted on the rack housing 22 whereby its actuator lever 58 cooperates with an extension 60 of a split cam 59 mounted on the lance tube 12. The limit switch means 53, 54, 55 are appropriately wired to an electrical control means (not shown) in a well known manner to open and close the power sources to the electric motor 20 and pinion 35.

In the operation of the deslagger of the invention, a cleaning cycle is commenced by either an automatic or manual control to activate the pinion 35 whereby the lance tube 12 is moved toward its operative, fully-extended position. During the initial horizontal motion of the lance tube 12, the rack member 24 will act to move the lever 56 of limit switch 53 to actuate the switch 53. This will close the power supply to the pinion 35 whereby the deslagger will continue to operate under its own control. The lance tube 12 will continue towards its operative position until the traversing rotary gear box 19 abuts the main support structure 11. Just prior to the abutting contact, the pin end 32 will engage the finger 33 to release the rack element 24 from its locked engagement with the transverse sleeve 25 so that the rack element will be able to continue its horizontal motion after the lance tube is fully extended and in its operative position. When the rack element reaches its fully-extended position, as illustrated in FIG. 5, the valve actuator lever 48 will be pivoted to operate the valve 13 whereby the cleaning fluid is discharged into the interior of the lance tube 12. Substantially simultaneously with the cleaning fluid discharge, the rack element 24 actuates the lever 57 of the limit switch means 54 to deactivate the power supply to the pinion 35 and close the source of electrical power to the electric motor 20 whereby rotational motion of the lance tube 12 will commence simultaneously with the pressure discharge of cleaning fluid from the lance tube nozzle. Accordingly, lance tube rotation and cleaning fluid discharge are accurately timed and coordinated such that the cleaning fluid has attained an appropriate pressure level for cleaning effectiveness as the lance tube is started in its rotational motion to direct the cleaning fluid across the surfaces of the boiler to be deslagged.

After the lance tube has been rotated through a full 360°, the pin 60 of split cam 69 will activate the lever 58 of limit switch 55. Operation of limit switch 55 activates the pinion 35 in the reverse direction to withdraw the rack element 24 from the valve actuator 40 and deactivate the electric motor 20 to stop rotation of the lance tube 12. Thus, cleaning fluid discharge and lance tube rotation are also completed substantially simultaneously with one another. Of course, the rack element 24 will initially move in its retracting direction until the pin end 32 relocks the rack element 24 to the sleeve 25 and thereafter continues in the righthand direction to retract the lance tube 12 to its non-working position. When the lance tube 12 has reached its non-working position, the lever 56 of limit switch 54 will be returned to its normal position and the power to pinion 35 will once again be discontinued. This completes the cleaning cycle of the deslagger with the lance tube fully retracted from the boiler and with the deslagger ready for the commencement of a new cleaning cycle in due course.

The present invention provides a mechanical linear and rotational drive arrangement which quickly and efficiently inserts the lance tube into an operative position within the boiler and advantageously and reliably coordinates the rotational movement of the nozzle with fluid discharge to achieve a highly effective cleaning action. The utilization of a traversing rotary gear box with a square shaft rotary input from a stationary rotary gear box permits the mounting of the electric rotary drive motor on the main support frame thereby reducing the overall weight of the lance tube to facilitate an easier longitudinal motion for the lance. As described, the lance weight reducing rotational drive is effectively operated in conjunction with the extensible rack element whereby cleaning fluid discharge is precisely timed to commence after the lance has been fully extended and substantially simultaneously with the commencement of rotational motion. By utilizing the rack member to both axially displace the lance tube and to activate the fluid discharge valve, the present invention provides an economy of working components while teaching a straightforward, highly reliable means to insert the lance tube into the boiler and to activate fluid discharge at the most advantageous time in the cleaning cycle. Moreover, the electric limit switch means provide an effective control for activating and deactivating the longitudinal and rotary drives so that the cleaning cycle of the deslagger is fully automatic.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A rotary wall deslagger, which comprises (a) a main support structure, (b) a lance tube rotatably, axially movably supported by said main support structure, (c) means to rotate said lance tube,
(d) means to axially displace said lance tube from a non-working position to a working position including a driving device and a driven element mechanically associated with said driving device,
(e) said driven element being mechanically coupled to said lance tube and selectively displaceable relative to said lance tube, and
(f) cleaning fluid discharge means associated with said lance tube,
(g) said driven element being in a normally-locked, mechanically-coupled relation with said lance tube, and being operative to activate said cleaning fluid discharge means,
(h) means to release said normally-locked, mechanically-coupled relation after said lance tube has been displaced to said working position whereby said driven element may be displaced relative to said lance tube to activate said cleaning fluid discharge means.

2. The rotary wall deslagger according to claim 1, further characterized by
(a) said driving device comprising a pinion,
(b) said driven element comprising a rack element in a driven engagement with said pinion,
(c) said rack element being mechanically associated with said lance tube and selectively displaceable relative to said lance tube.

3. The rotary wall deslagger according to claim 2, further characterized by
(a) a sleeve-like element fixedly associated with said lance tube,
(b) said rack element being slidably received within said sleeve-like element, and
(c) locking means to selectively lock said rack element to said sleeve-like element.

4. The rotary wall deslagger according to claim 3, further characterized by
(a) said cleaning fluid discharge means being aligned with the front end of said rack element,
(b) disengaging means operative to cooperate with and release said locking means when said lance tube is in the working position whereby said rack element may be displaced in said sleeve-like element relative to said lance tube to engage and operate the aligned cleaning fluid discharge means.

5. The rotary wall deslagger according to claim 4, further characterized by
(a) said cleaning fluid discharge means comprising a valve and a lever-type valve actuator,
(b) said rack element being engageable with said lever-type valve actuator to pivot said lever-type actuator to open the valve.

6. The rotary wall deslagger according to claim 3, further characterized by
(a) spring means acting between said rack element and said sleeve-like element to urge said rack element toward the locked position with said sleeve-like element.

7. The rotary wall deslagger according to claim 3, 4 or 6, further characterized by
(a) said sleeve-like element including an opening,
(b) said rack element including a bore formed therein which is normally aligned with said opening, and
(c) a pin-like element received in said bore and extending through said opening to lock said rack element to said sleeve-like element.

8. The rotary wall deslagger according to claim 7, further characterized by
(a) said disengaging means comprising a finger-like element mounted to said main support structure and arranged and configured to cooperate with said pin-like element at a predetermined axial position of said rack element whereby said disengaging finger displaces said pin out of the opening to release the rack element for relative axial displacement with respect to said sleeve-like element.

9. The rotary wall deslagger according to claim 3, further characterized by
(a) said means to rotate said lance tube comprising a stationary rotary gear box mounted to said main support structure and a traversing rotary gear box mounted to and movable with said lance tube,
(b) a drive shaft mounted between and mechanically coupling said stationary and traversing rotary gear boxes, and
(c) an electric-drive motor mounted to said stationary rotary gear box.

10. The rotary wall deslagger according to claim 9, further characterized by
(a) said drive shaft comprising a square drive shaft.

11. The rotary wall deslagger according to claim 9, further characterized by
(a) said sleeve-like element being mounted to said traversing rotary gear box.

12. The rotary wall deslagger according to claim 1, further characterized by
(a) an electrical limit switch means associated with said rotary wall deslagger including lever-type actuators,
(b) said lever-type actuators being activated by lance tube movement to provide automatic electrical control for said rotary wall deslagger.

13. A rotary wall deslagger which comprises
(a) a main support structure,
(b) a lance tube rotatably supported by said main support structure for traverse motion between working and non-working positions,
(c) cleaning fluid discharge means associated with said lance tube,
(d) integrated means for moving said lance tube between said working and non-working positions and for activating said cleaning fluid discharge means,
(e) said integrated means including a selectively-operable, mechanical coupling means for mechanically-engaging said integrated means with said lance tube to move said lance tube,
(f) means to release said selectively-operable, mechanical coupling means when said lance tube is in the working position,
(g) said integrated means being operative to activate said cleaning fluid discharge means when said mechanical coupling means is released.

14. The rotary wall deslagger according to claim 13, further characterized by
(a) means to rotate said lance tube,
(b) electro-mechanical means operative to activate said rotating means,
(c) said integrated means being operative to activate said electro-mechanical means after said lance tube is in the working position and substantially simultaneously with the activation of the cleaning fluid discharge means by said integrated means.

* * * * *